US009488010B2

(12) United States Patent
von Gynz-Rekowski et al.

(10) Patent No.: US 9,488,010 B2
(45) Date of Patent: Nov. 8, 2016

(54) HAMMER DRILL

(71) Applicant: Ashmin, LC, Conroe, TX (US)

(72) Inventors: Gunther H-H von Gynz-Rekowski, Montgomery, TX (US); Michael V. Williams, Montgomery, TX (US); William C. Herben, Magnolia, TX (US)

(73) Assignee: Ashmin, LC, Conroe, TX (US)

( * ) Notice: Subject to any disclaimer, the term of this patent is extended or adjusted under 35 U.S.C. 154(b) by 626 days.

(21) Appl. No.: 13/848,839

(22) Filed: Mar. 22, 2013

(65) Prior Publication Data

US 2013/0264119 A1 Oct. 10, 2013

Related U.S. Application Data

(60) Provisional application No. 61/615,518, filed on Mar. 26, 2012.

(51) Int. Cl.
*E21B 4/10* (2006.01)
*E21B 10/36* (2006.01)

(52) U.S. Cl.
CPC *E21B 10/36* (2013.01); *E21B 4/10* (2013.01)

(58) Field of Classification Search
CPC ..... E21B 4/10; E21B 17/07; E21B 6/00
See application file for complete search history.

(56) References Cited

U.S. PATENT DOCUMENTS 1,845,074 A * 2/1932 Adolphis ..... 175/298
2,348,047 A * 5/1944 Yost ..... E21B 4/02 175/107
2,613,917 A * 10/1952 Postlewaite ..... 175/106
2,634,951 A 4/1953 Snyder
2,641,445 A * 6/1953 Snyder ..... 175/93
2,694,551 A * 11/1954 Snyder ..... 175/56
2,742,264 A * 4/1956 Suyder ..... 175/298
2,889,711 A 6/1959 Morris
2,902,258 A 9/1959 Hildebrandt
2,974,533 A 3/1961 Demo
3,031,015 A * 4/1962 De Cordova ..... 166/55.6
3,363,700 A 1/1968 Bogusch
3,837,414 A 9/1974 Swindle
4,071,097 A 1/1978 Fulop et al.
4,261,425 A 4/1981 Bodine
4,384,625 A 5/1983 Roper et al.
5,396,965 A 3/1995 Hall et al.

(Continued)

OTHER PUBLICATIONS

Barton, Steve; Cote, Brad; DA Fonseca, Carlos Eduardo; Gee, Ryan; Ramirez, Tibor; De Souza, Julio Cezar; Valmorbida, Decio, Hammer Motor Smashes Its Way to Speedy Success in Brazil,SPE/IADC Drilling Conference and Exhibition, 2011, Amsterdam.

(Continued)

*Primary Examiner* — Kipp Wallace
(74) *Attorney, Agent, or Firm* — Jones Walker, LLP

(57) ABSTRACT

A downhole apparatus connected to a workstring within a wellbore. The workstring is connected to a bit member. The apparatus includes a mandrel operatively connected to a downhole motor mechanism, an anvil member operatively formed on the bit member, the anvil member being operatively connected to the mandrel, a radial bearing housing unit operatively connected to the workstring, with the radial bearing housing unit being disposed about the mandrel, and a hammer member slidably attached to the radial bearing housing unit.

26 Claims, 6 Drawing Sheets

(56) References Cited

U.S. PATENT DOCUMENTS

| | | | | |
|---|---|---|---|---|
| 5,503,228 | A | 4/1996 | Anderson | |
| 5,680,904 | A | 10/1997 | Patterson | |
| 5,711,380 | A | 1/1998 | Chen | |
| 6,230,819 | B1 | 5/2001 | Chen | |
| 6,290,004 | B1 | 9/2001 | Evans | |
| 6,431,294 | B1 | 8/2002 | Eddison et al. | |
| 6,481,495 | B1 | 11/2002 | Evans | |
| 6,508,317 | B2 | 1/2003 | Eddison et al. | |
| 6,684,964 | B2 | 2/2004 | Ha | |
| 6,742,605 | B2 | 6/2004 | Martini | |
| 6,745,836 | B2 | 6/2004 | Taylor et al. | |
| 6,761,231 | B1 | 7/2004 | Dock et al. | |
| 7,011,156 | B2 | 3/2006 | von Gynz-Rekowski | |
| 7,032,687 | B2 | 4/2006 | Rask | |
| 7,191,848 | B2 | 3/2007 | Ha | |
| 7,392,857 | B1 | 7/2008 | Hall et al. | |
| 7,484,576 | B2 | 2/2009 | Hall et al. | |
| 7,658,238 | B2 | 2/2010 | Toukairin et al. | |
| 2002/0185312 | A1* | 12/2002 | Armell et al. | 175/19 |
| 2003/0230422 | A1 | 12/2003 | Ha | |
| 2004/0035595 | A1 | 2/2004 | Fisher | |
| 2004/0089461 | A1 | 5/2004 | Cioceanu | |
| 2005/0230153 | A1 | 10/2005 | Minshull et al. | |
| 2006/0016612 | A1 | 1/2006 | Ha | |
| 2007/0137897 | A1 | 6/2007 | Sanders et al. | |
| 2007/0221412 | A1 | 9/2007 | Hall et al. | |
| 2008/0029312 | A1 | 2/2008 | Hall et al. | |
| 2008/0099245 | A1 | 5/2008 | Hall et al. | |
| 2010/0108385 | A1 | 5/2010 | Hall et al. | |
| 2010/0276204 | A1 | 11/2010 | Connell et al. | |
| 2011/0031020 | A1 | 2/2011 | Cote | |
| 2011/0247882 | A1 | 10/2011 | Hall et al. | |
| 2012/0073878 | A1 | 3/2012 | Zulak et al. | |
| 2012/0097453 | A1 | 4/2012 | Hall et al. | |

OTHER PUBLICATIONS

Cote, Brad; Francis, Brenda; Staysko, Robert, Fluid Hammer Drives Down Well Costs, SPE/IADC Drilling Conference and Exhibition, 2011, Amsterdam.

Byfield, Mike, A Former Hockey Enforcer Creates a Fluid Hammer, Technology Stars, Dec. 2010.

Extended European search report (including supplementary European search report and European search opinion) from applicant's counterpart European Patent Application No. 13768527.7.

* cited by examiner

HAMMER DRILL

This application claims priority from U.S. provisional patent application Ser. No. 61/615,518, entitled "Hammer Drill" and filed on 26 Mar. 2012, which is incorporated herein by reference.

BACKGROUND OF THE INVENTION

This invention relates to downhole tools. More particularly, but not by way of limitation, this invention relates to a downhole percussion tool.

In the drilling of oil and gas wells, a bit means is utilized to drill a wellbore. Downhole percussion tools, sometimes referred to as hammers, thrusters, or impactors are employed in order to enhance the rate of penetration in the drilling of various types of subterranean formations. In some types of wellbores, such as deviated and horizontal wells, drillers may utilize downhole mud motors. The complexity and sensitivity of bottom hole assemblies affects the ability of drillers to use certain tools, such as downhole hammers.

SUMMARY OF THE INVENTION

In one embodiment, a downhole apparatus connected to a workstring within a wellbore is disclosed. The workstring is connected to a bit member. The apparatus comprises a power mandrel operatively connected to a motor means; an anvil member operatively formed on the bit member, the anvil member being operatively connected to the power mandrel; a radial bearing housing unit operatively connected to the workstring, with the radial bearing housing unit being disposed about the power mandrel; a spring saddle operatively attached to the radial bearing housing unit; a spring spacer disposed about the spring saddle; a spring having a first end and a second end, with the first end abutting the spring saddle; a hammer member slidably attached to the spring saddle, and wherein the hammer member abuts the second end of the spring. In one preferred embodiment, the hammer and the anvil is below the radial bearing housing unit. The workstring may be a tubular drill string, or coiled tubing or snubbing pipe. The anvil member contains a radial cam face having an inclined portion and a upstanding portion. The hammer member contains a radial cam face having an inclined portion and a upstanding portion.

In another embodiment, a downhole apparatus is connected to a workstring within a wellbore, with the downhole apparatus connected to a bit member. The apparatus comprises a mandrel operatively connected to a motor means; an anvil operatively formed on the bit member, with the anvil being operatively connected to the mandrel; a radial bearing housing unit operatively connected to the workstring, with the radial bearing housing unit being disposed about the mandrel; and a hammer slidably attached to the radial bearing housing unit. In one embodiment, the hammer and the anvil is below the radial bearing housing unit. The anvil contains a cam face having an inclined portion and an upstanding portion, and the hammer contains a cam face having an inclined portion and a upstanding portion. The apparatus may optionally further include a spring saddle operatively attached to the radial bearing housing unit; and, a spring spacer disposed about the spring saddle, with a spring having a first end and a second end, with the first end abutting the spring spacer. In one embodiment, the hammer is slidably attached to the radial bearing housing unit with spline means operatively positioned on the spring saddle.

Also disclosed in one embodiment, is a method for drilling a wellbore with a workstring. The method includes providing a downhole apparatus connected to the workstring within a wellbore, the apparatus being connected to a bit member, the downhole apparatus comprising: a power mandrel operatively connected to a motor means, thereby providing torque and rotation from the motor to the bit via the power mandrel, an anvil member operatively formed on the bit member, the anvil member being operatively connected to the power mandrel; a radial bearing housing unit operatively connected to the workstring, with the radial bearing housing unit being disposed about the power mandrel; a spring saddle operatively attached to the radial bearing housing unit; a spring spacer disposed about the spring saddle, a spring having a first end and a second end, with the first end abutting the spring-spacer; a hammer member slidably attached to the spring saddle, and wherein the hammer member abuts the second end of the spring. The method further includes lowering the workstring into the wellbore; contacting the bit member with a subterranean interface (such as reservoir rock); engaging a distal end of the power mandrel with an inner surface of the bit member; slidably moving the anvil member; and, engaging a radial cam surface of the anvil member with a reciprocal radial cam surface of the hammer member so that the hammering member imparts a hammering (sometimes referred to as oscillating) force on the anvil member.

In one disclosed embodiment, when activating the motor (pumping fluid), the power mandrel, the drive shaft and the bit box sub are spinning the bit. If the hammermass cam surface and the anvil cam surface are engaged, the hammering (i.e. percussion) is activated and adds an oscillating force to the bitbox sub. Thus, the bit will be loaded with the static weight on bit from the drill string and the added oscillating force of the impacting hammermass. If the hammermass cam surface and the anvil cam surface are disengaged, the bitbox sub is only rotating.

A feature of the disclosure is that the spring means is optional. With regard to the spring embodiment, the type of spring used may be a coiled spring or Belleville spring. An aspect of the spring embodiment includes if the hammermass cam surface and the anvil cam surface are engaged and the hammermass is sliding axially relative to the anvil member, the spring means will be periodically compressed and released thus periodically accelerating the hammermass towards the anvil member that in turn generates an additional impact force. A feature of the spring embodiment is the spring adjusted resistance without moving the mandrel relative to the housing. Another feature of one embodiment is the mandrel is defined by supporting the axial and radial bearings. Another feature of one embodiment is that the hammer mechanism can be located between the bit and the motor or below the bearing section and the motor.

As per the teachings of the present disclosure, yet another feature includes that the motor means turns and hammers (i.e. oscillating force) when drilling fluid is pumped through the motor and both cam faces are engaged. Another feature is the motor only turns when drilling fluid is pumped through the motor and both cam faces are disengaged. The motor does not turn nor hammers when no drilling fluid is pumped.

DETAILED DESCRIPTION OF THE PREFERRED EMBODIMENTS

Figure 1:
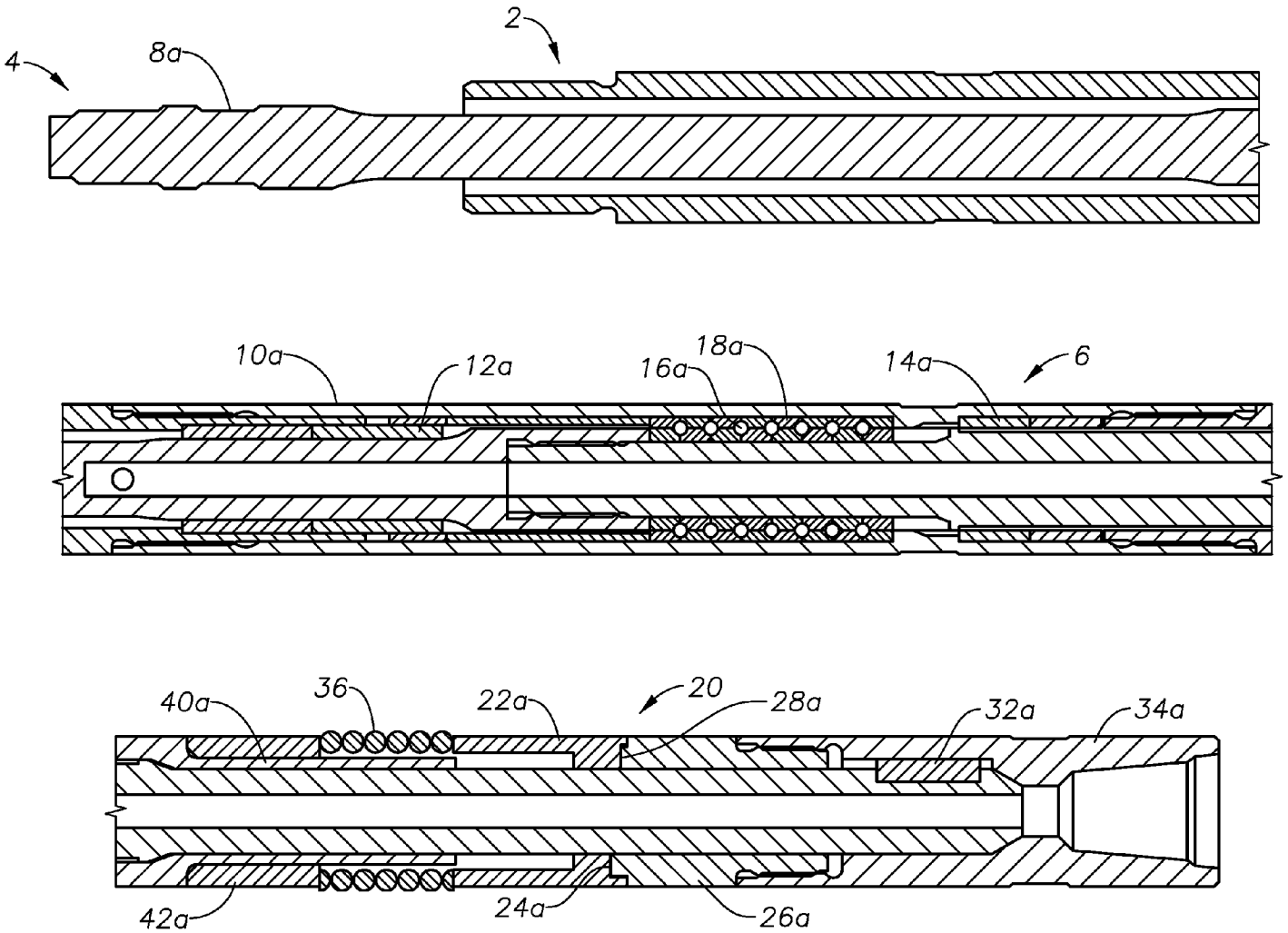
FIG. 1 is a partial sectional view of a first embodiment of the downhole apparatus.

Referring now to the FIG. 1, a partial sectional view of the downhole apparatus 2 of a first embodiment will now be discussed. The first embodiment apparatus 2 includes a power mandrel, seen generally at 4, that is operatively attached to the output of a downhole mud motor (not shown). The apparatus 2 also includes a radial bearing housing unit, seen generally at 6. The radial bearing housing unit 6 will be operatively attached to the workstring, such as drill pipe or coiled tubing, as will be described later in this disclosure. More particularly, FIG. 1 shows the power mandrel 4 (which is connected to the output of the motor section, as is well understood by those of ordinary skill in the art). The mandrel 4 may be referred to as the power mandrel or flex shaft. Also shown in FIG. 1 is the upper bearing housing 101*a* which includes the upper radial bearings 12*a*, lower radial bearing 14*a*, balls 16*a* and thrust races 18*a*. The lower housing is seen generally at 20 in FIG. 1 and will be described in further detail.

As seen in FIG. 1, a partial sectional view of lower housing 20 of the downhole apparatus 2 of the first embodiment is shown. FIG. 1 depicts the hammermass 22*a*(sometimes referred to as the hammer member or hammer), which is attached (for instance, by spline means via a spring saddle 40*a*) to the radial bearing housing unit 6. The hammermass 22*a*will have a radial cam surface 24*a*. The hammermass 22*a* will engage with the anvil 26*a*, wherein the anvil 26*a* has a first end that contains a radial cam surface 28*a*, wherein the radial cam surface 28*a* and radial cam surface 24*a* are reciprocal and cooperating in the preferred embodiment, as more fully set out below. FIG. 1 also depicts the power mandrel 4, which is fixed connected to the driveshaft 30*a* via thread connection or similar means. A key 32*a*(also referred to as a spline) allows for rotational engagement of the power mandrel 4 and the driveshaft 30*a* with the bitbox sub 34*a*, while also allowing for lateral movement of the bitbox sub 34*a* relative to the drive shaft 30*a*. The anvil 26*a* is fixedly connected to the bitbox sub 34*a*.

FIG. 1 also depicts the spring means 36 for biasing the hammermass 22*a*. The spring means 36 is for instantaneous action. More specifically, FIG. 1 depicts the spring saddle 40*a* that is an extension of the bearing housing 6 i.e. the spring saddle 40*a* is attached (via threads for instance) to the bearing housing 6. The spring saddle 40*a* is disposed about the driveshaft 30*a*. Disposed about the spring saddle 40*a* is the spacer sub 42*a*, wherein the spacer sub 42*a* can be made at a variable length depending on the amount of force desired to load the spring means 36. As shown, the spring means 36 is a coiled spring member. The spring means 36 may also be a Belleville washer spring. One end of the spring means 36 abuts and acts against the hammermass 22*a* which in turn urges to engagement with the anvil 26*a*.

Figure 2:
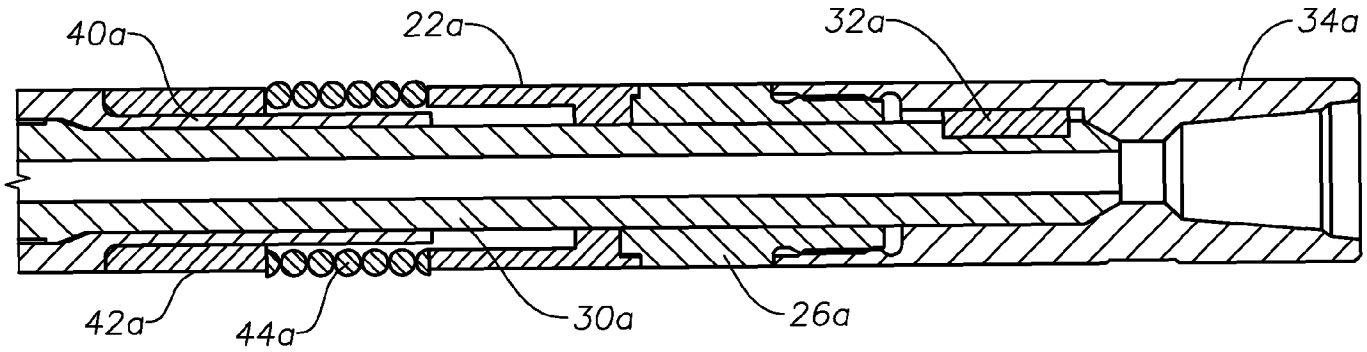
FIG. 2 is a partial sectional view of lower housing of the downhole apparatus of the first embodiment in the engaged mode.
Figure 3:
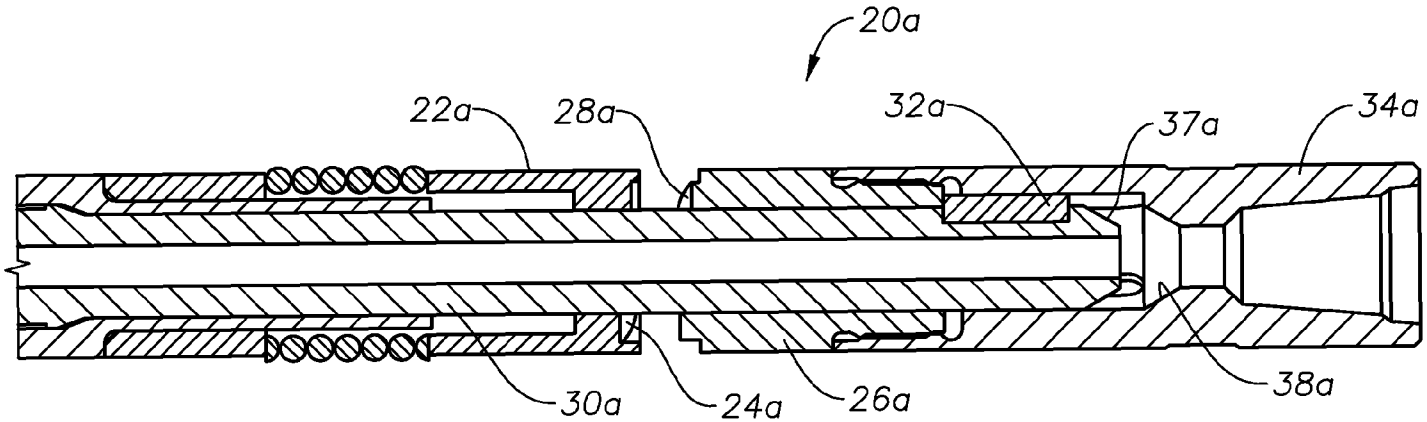
FIG. 3 is a partial sectional view of the lower housing of the downhole apparatus of the first embodiment in the disengaged mode.

In FIG. 2, a partial sectional view of the lower housing 20*a* of the downhole apparatus 2 of the first embodiment in the engaged mode is shown. It should be noted that like numbers appearing in the various figures refer to like components. The cam surface 24*a* and cam surface 28*a* are abutting and are face-to-face. Note the engaged position of the end 37*a* of the driveshaft 30*a* with the angled inner surface 38*a* of the bitbox sub 34*a* securing the axial transmission of the WOB from the drillstring to the bitbox sub 34*a* and the bit (not showing here). In FIG. 3, a partial sectional view of the lower housing 20*a* of the downhole apparatus 2 of the first embodiment in the disengaged mode will now be described. In this mode, the apparatus 2 can be, for instance, running into the hole or pulling out of the hole, as is well understood by those of ordinary skill in the art. Therefore, the radial cam surface 24*a* of hammer 22*a* is no longer engaging the radial cam surface 28*a* of the anvil 26*a*. Note the position of the end 37*a* of the driveshaft 30*a* in relation to the angled inner surface 38*a* of the bitbox sub 34*a*. As stated previously, the bit member (not shown in this view) is connected by ordinary means (such as by thread means) to the bitbox sub 34*a*.

Figure 4:
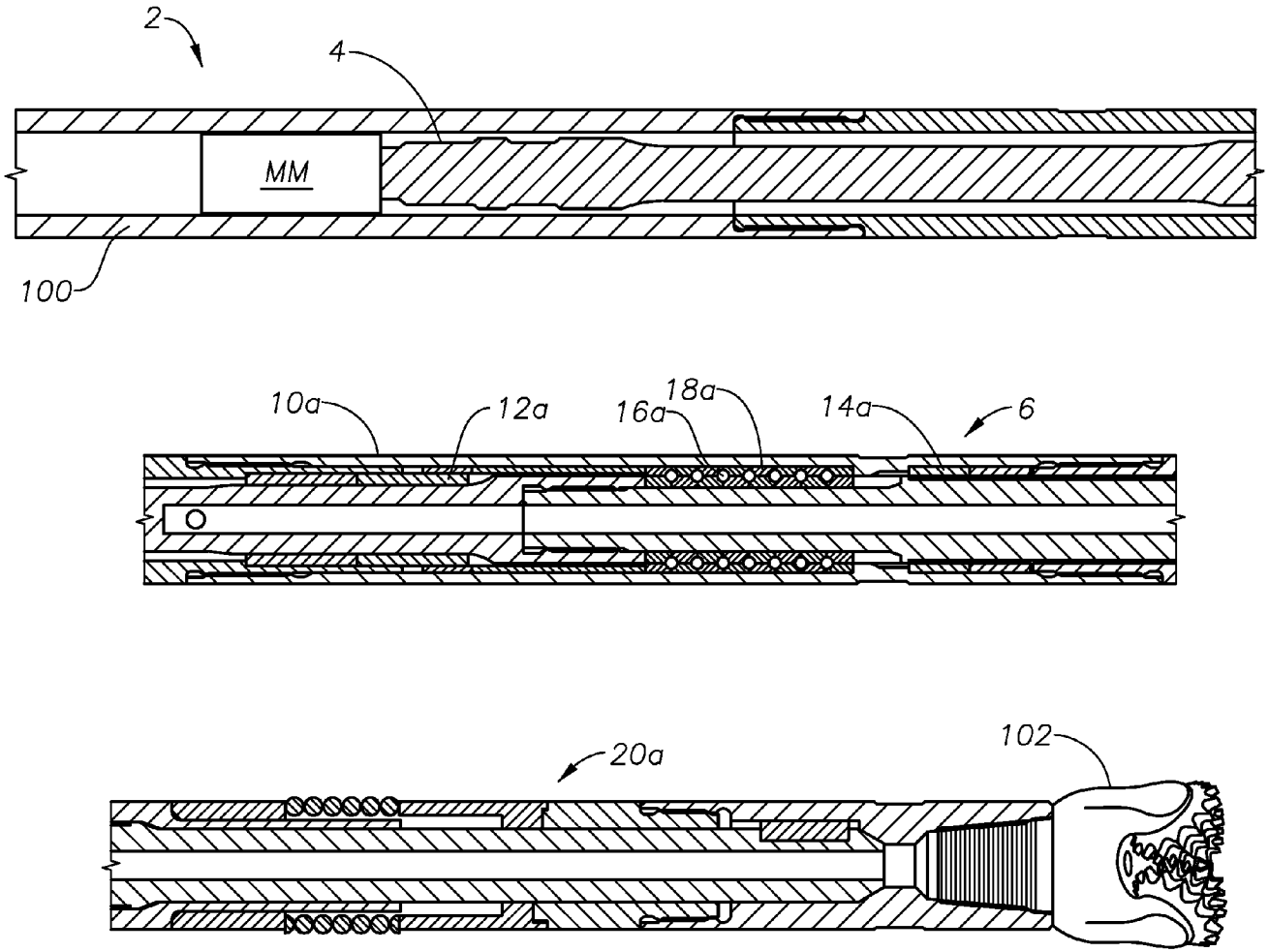
FIG. 4 is a partial sectional view of the downhole apparatus of the first embodiment as part of a bottom hole assembly.

Referring now to the FIG. 4, a schematic view of the downhole apparatus 2 of the first embodiment will now be discussed as part of a bottom hole assembly. The first embodiment the apparatus 2 includes the power mandrel, seen generally at 4, that is operatively attached to the output of a downhole mud motor "MM". The apparatus 2 also includes a radial bearing housing unit, seen generally at 6. The radial bearing housing unit 6 will be operatively attached to the workstring 100, such as drill pipe or coiled tubing. Also shown in FIG. 4 is the upper bearing housing 10*a* which includes the upper radial bearings 12*a*, lower radial bearing 14*a*, balls 16*a* and thrust races 18*a*. The lower housing is seen generally at 20*a*. As shown in FIG. 4, the bit 102 is attached to the apparatus 2, wherein the bit 102 will drill the wellbore as readily understood by those of ordinary skill in the art.

Figure 5:
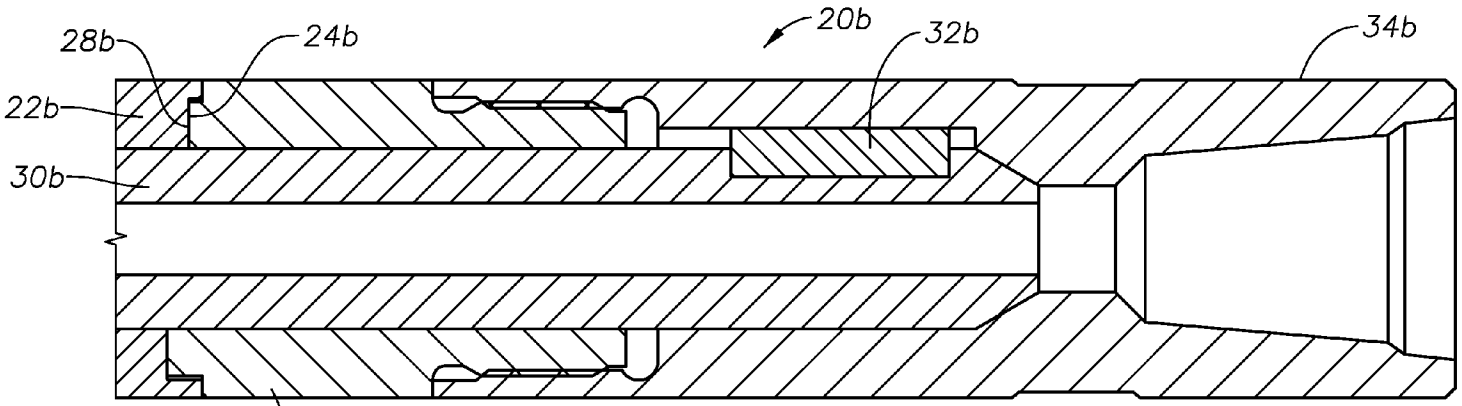
FIG. 5 is a partial sectional view of lower housing of the downhole apparatus of a second embodiment in the engaged mode.
Figure 6:
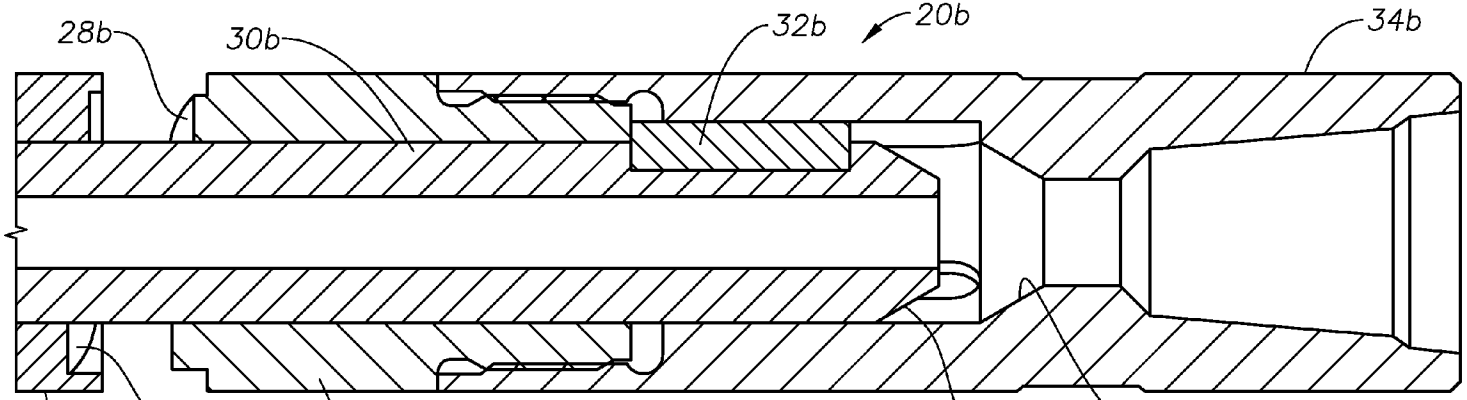
FIG. 6 is a partial sectional view of the lower housing of the downhole apparatus of the second embodiment in the disengaged mode.

FIG. 5 and FIG. 6 depict the embodiment of the apparatus 2 without the spring means. Referring now to FIG. 5, a partial sectional view of lower housing 20*b* of the downhole apparatus 2 of a second embodiment in the engaged mode is shown. FIG. 5 depicts the hammermass 22*b* (sometimes referred to as the hammer member or hammer), which is attached (for instance, by spline means) to the spring saddle and the radial bearing housing unit (not shown here). The hammermass 22*b* will have a radial cam surface 24*b*. The hammermass 22*b* will engage with the anvil 26*b*, wherein the anvil 26*b* has a first end that contains a radial cam surface

28*b*, wherein the radial cam surface 28*b* and radial cam surface 24*b* of the hammermass 22*b* are reciprocal and cooperating in the preferred embodiment, as more fully set out below. FIG. 5 also depicts the driveshaft 30*b* (with the driveshaft 30*b* being connected to the power mandrel, not shown here). A key 32*b* (also referred to as a spline) allows for rotational engagement of the drive shaft 30*b* with the bitbox sub 34*b*, while also allowing for lateral movement of the bitbox sub 34*b* relatively to the driveshaft 30*b*-. The anvil 26*b* is fixed connected to the bitbox sub 34*b*.

In FIG. 6, a partial sectional view of the lower housing 20*b* of the downhole apparatus 2 of the second embodiment in the disengaged mode will now be described. In this mode, the apparatus 2 can be, for instance, running into the hole or pulling out of the hole, as well understood by those of ordinary skill in the art. Hence, the radial cam surface 24*b* of hammermass 22*b* is no longer engaging the radial cam surface 28*b* of the anvil 26*b*. Note the position of the end 37*b* of the driveshaft 30*b* in relation to the angled inner surface 38*b* of the bitbox sub 34*b*. As previously mentioned, a bit member is connected (such as by thread means) to the bitbox sub 34*b*.

Figure 7A:
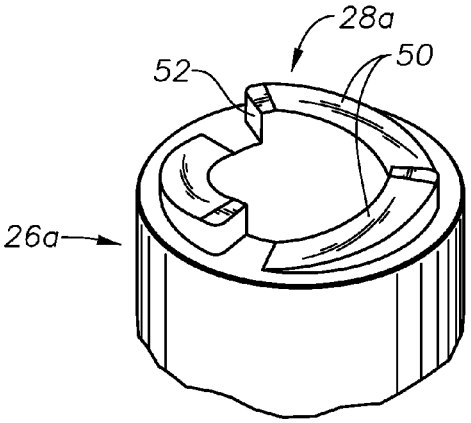
FIG. 7A is perspective view of one embodiment of the anvil radial cam member.
Figure 7B:
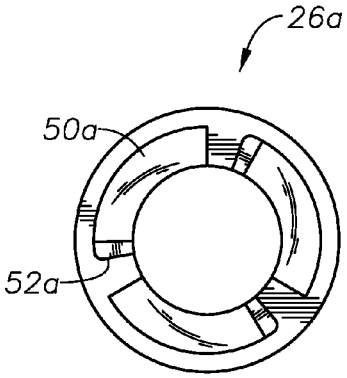
FIG. 7B is a top view of the anvil radial cam member seen in FIG. 7A.

Referring now to FIG. 7A, a perspective view of one embodiment of the anvil radial cam member. More specifically, FIG. 7A depicts the anvil 26*a* having the radial cam surface 28*a*, wherein the radial cam surface 28*a* includes an inclined portion 50, horizontal (flat) portion 51, and an upstanding portion 52. The inclined portion 50 may be referred to as a ramp that leads to the vertical upstanding portion 52 as seen in FIG. 7A. FIG. 7B is a top view of the anvil radial cam member seen in FIG. 7A. In one embodiment, multiple ramps (such as inclined portion 50, horizontal portion 51, extending to an upstanding portion 52) can be provided on the radial cam surface 26*a*.

Figure 8:
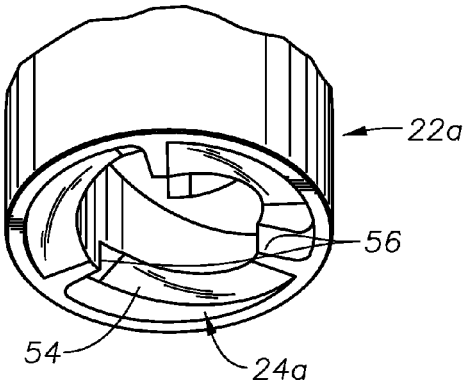
FIG. 8 is a perspective view of one embodiment of the hammer radial cam member.

In FIG. 8, a perspective view of one embodiment of the hammer radial cam member is depicted. More specifically, FIG. 8 shows the hammermass 22*a* that has a radial cam surface 24*a*. The radial cam surface 24*a* also has an inclined portion 54, horizontal (flat) portion 55 and an upstanding portion 56, which are reciprocal and cooperating with the inclined portion and upstanding portion of the anvil radial cam surface 28*a*, as noted earlier. Note that the cam means depicted in FIGS. 7A, 7B and 8 will be the same cam means for the second embodiment of the apparatus 2 illustrated in FIGS. 5 and 6.

Figure 9:
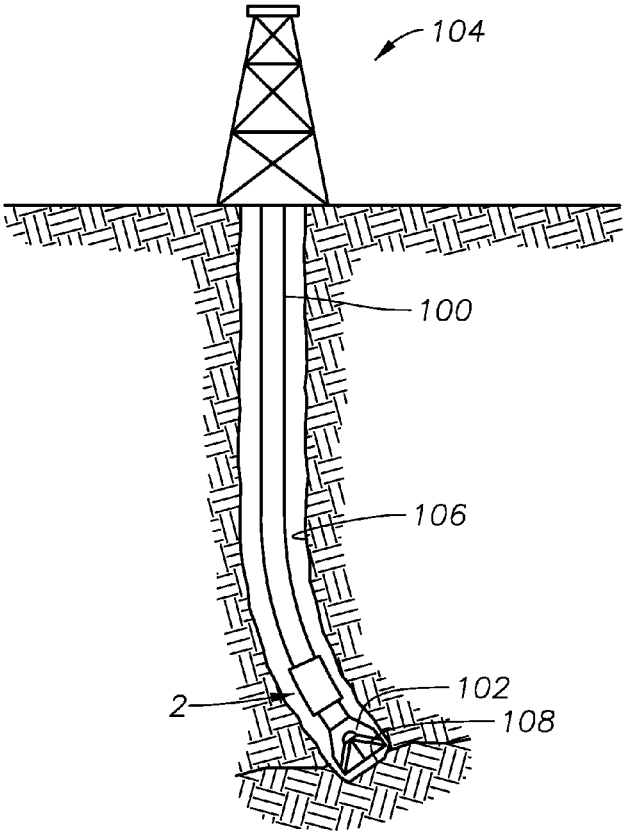
FIG. 9 is a schematic depicting the downhole apparatus of the present invention in a wellbore.

A schematic of a drilling rig 104 with a wellbore extending therefrom is shown in FIG. 9. The downhole apparatus 2 is generally shown attached to a workstring 100, which may be a drill string, coiled tubing, snubbing pipe or other tubular. The bit member 102 has drilled the wellbore 106 as is well understood by those of ordinary skill in the art. The downhole apparatus 2 can be used, as per the teachings of this disclosure, to enhance the drilling rate of penetration by use of a percussion effect with the hammer 22*a*/22*b* impacting force on the anvil 26*a*/26*b*, previously described. In one embodiment, the downhole hammer is activated by the bit member 102 coming into contact with a reservoir interface, such as reservoir rock 108 found in subterranean wellbores or other interfaces, such as bridge plugs. In one embodiment, a driller can drill and hammer at the same time. As per the teachings of this invention, in the spring (first) embodiment, the hammermass will be accelerated by a spring force of the compressed spring thus generating an impact force when the hammermass hits the anvil member.

Figure 10A:
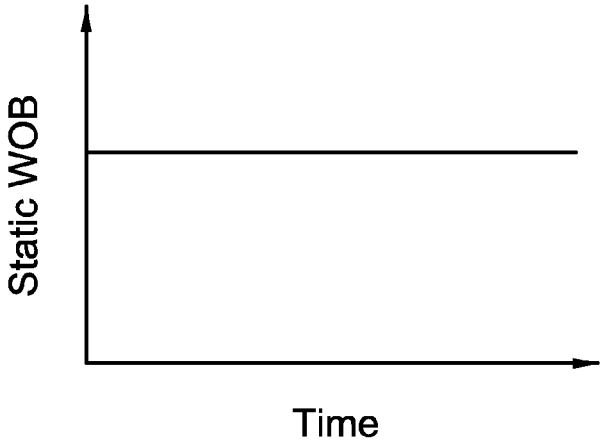
FIG. 10A is a graph of static weight on bit (WOB) versus time during drilling operations.
Figure 10B:
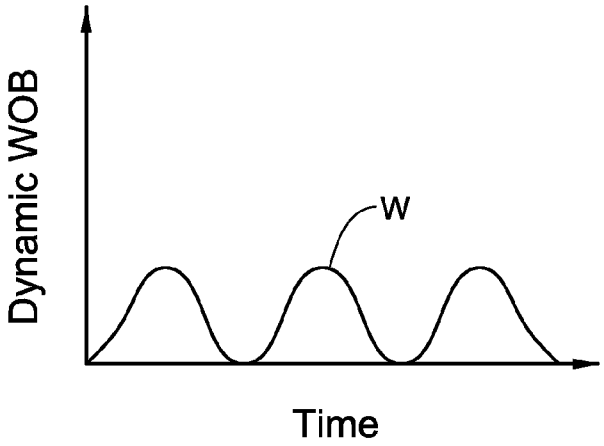
FIG. 10B is a graph of dynamic WOB utilizing a percussion unit.
Figure 10C:
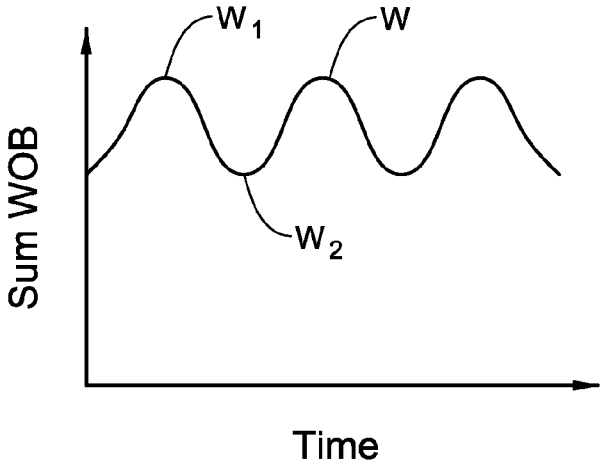
FIG. 10C is a graph of dynamic WOB utilizing percussion unit, wherein the impact force is overlaid relative to the static load.

Referring now to FIGS. 10A, 10B and 10C, graphs of the weight on bit (WOB) versus time during drilling operations will now be discussed. More specifically, FIG. 10A is the static WOB versus time; FIG. 10B is a dynamic WOB utilizing the hammer and anvil members (i.e. percussion unit); and, FIG. 10C represents -the summarized WOB wherein the impact force is graphically overlaid (i.e. summation) relative to the static load, in accordance with the teachings of this disclosure. As noted earlier, the percussion unit is made-up of the anvil, hammer, cam shaft arrangement and spring. The wave form W depicted in FIGS. 10B and 10C represent the oscillating impact force of the percussion unit during use. Note that in FIG. 10C, W1 represents the force when the hammermass impacts the anvil and W2 represents the force when the hammermass does not impact the anvil. It must be noted that the size and shape of the wave form can be diverse depended on the material and the design of the spring, the anvil, the hammermass and the spacer sub.

An aspect of the disclosure is that the static weight of the drill string is transmitted different to the bit than the impact force (dynamic weight on bit) created by the hammer and anvil member. The static WOB is not transmitted through the hammer and anvil members including cam surface (i.e. cam shaft arrangement). The impact force is transmitted through the hammer and anvil to the bit and not through the camshaft arrangement. The percussion unit will generate the impact force if the cam shafts arrangements are engaged independently of the amount of WOB. Yet another aspect of one embodiment of the disclosure is the power section of the motor is simultaneously rotationally driving the bit and axially driving the hammer member. No relative axial movement is taking place between the housing of the apparatus and the inner drive train (including the power mandrel and the driveshaft) that is driving the bit and the percussion unit.

Another aspect of the one embodiment is the anvil is positioned as close as possible to the bit; the bit box and/or bit can function as an anvil. Still yet another aspect of one embodiment is that when the bit does not encounter a resistance, no interaction between the two cams is experienced and thus no percussion motion.

It will be apparent to one skilled in the art that modifications may be made to the illustrated embodiments without departing from the spirit and scope of the invention. Insofar as the description above and the accompanying drawing disclose any additional subject matter that is not within the scope of the claims below, the inventions are not dedicated to the public and right to file one or more applications to claim such additional inventions is reserved.

We claim:

1. A downhole apparatus connected to a workstring within a wellbore, comprising:

a power mandrel operatively connected to a motor means;

an anvil member operatively formed on a bit member, the anvil member being operatively connected to the power mandrel;

a radial bearing housing unit operatively connected to the workstring, the radial bearing housing unit being disposed about the power mandrel;

a spring saddle having an upper section and a lower section, the upper section of the spring saddle being operatively and directly attached to the radial bearing housing unit;

a spring spacer disposed about the lower section of the spring saddle;

a spring having a first end and a second end, wherein the spring is operatively disposed about the lower section of the spring saddle with the first end of the spring abutting the spring spacer; and a hammer member slidably positioned between the anvil member and the spring saddle, wherein the hammer member abuts the second end of the spring.

2. The apparatus of claim 1 wherein the hammer member and the anvil member are positioned below the radial bearing housing unit.

3. The apparatus of claim 2 wherein the workstring is a tubular drill string.

4. The apparatus of claim 2 wherein the workstring is a coiled tubing string.

5. The apparatus of claim 2 wherein the anvil member contains a radial face having an inclined portion and an upstanding portion.

6. The apparatus of claim 2 wherein the hammer member contains a radial face having an inclined portion and an upstanding portion.

7. A method for drilling a wellbore with a workstring, comprising the steps of:

a) providing a downhole apparatus connected to the workstring within the wellbore, the downhole apparatus comprising: a power mandrel operatively connected to a motor means; an anvil member with a radial cam surface operatively formed on a bit member, the anvil member being operatively connected to the power mandrel; a radial bearing housing unit operatively connected to the workstring, the radial bearing housing unit being disposed about the power mandrel; a spring saddle having an upper section and a lower section, the upper section of the spring saddle being operatively and directly attached to the radial bearing housing unit; a spring spacer disposed about the lower section of the spring saddle, a spring having a first end and a second end, wherein the spring is operatively disposed about the lower section of the spring saddle with the first end of the spring abutting the spring spacer; a hammer member with a radial cam surface slidably positioned between the anvil member and the spring saddle, wherein the hammer member abuts the second end of the spring;

b) lowering the workstring into the wellbore;

c) contacting the bit member with a reservoir interface;

d) engaging a distal end of the power mandrel with a surface of the bit member;

e) engaging the radial cam surface of the anvil member with the radial cam surface of the hammer member so that the hammer member imparts an impact force on the anvil member that is transmitted to the bit member in the form of a dynamic weight on bit member.

8. The method of claim 7 wherein the workstring produces a static load that is transmitted to the bit member in the form of a static weight on bit member, wherein the static weight on bit member and the dynamic weight on bit member represent a maximum force on bit member.

9. The method of claim 8 wherein the static weight on bit member is transmitted to the bit member substantially without transmission through the hammer and anvil members.

10. The method of claim 8 wherein the dynamic weight on bit member is an oscillating impact force generated substantially independent of the static weight on bit member.

11. The method of claim 7 further comprising the step of causing the motor means to rotate the power mandrel and a drive shaft operatively coupled to the power mandrel to simultaneously rotationally drive the bit member and axially drive the hammer member.

12. The method of claim 11 wherein no relative axial movement takes place between the radial bearing housing unit and the power mandrel and drive shaft that are rotationally driving the bit member and axially driving the hammer member.

13. The method of claim 7 wherein the anvil member is a bit box sub operatively connected to the bit member.

14. The method of claim 7 wherein when the radial cam surface of the hammer member and the radial cam surface of the anvil member are engaged, and the hammer member is sliding axially relative to the anvil member, the spring will be periodically compressed and released thereby periodically accelerating the hammer member towards the anvil member which in turn generates an additional impact force.

15. A hammer drill apparatus, comprising:

a flex shaft having an upper section and a lower section, the upper section of the flex shaft in operative arrangement with a mud motor, the lower section of the flex shaft operatively coupled to an upper section of a drive shaft;

a radial bearing housing having an upper section, a middle section, a lower section and an internal bore extending through the upper, middle and lower sections, a portion of the flex shaft and a portion of the drive shaft positioned within the internal bore of the radial bearing housing;

one or more upper radial bearings positioned between an outer surface of the lower section of the flex shaft and an inner surface of the upper section of the radial bearing housing;

one or more thrust race bearing assemblies positioned between an outer surface of the upper section of the drive shaft and the inner surface of the middle section of the radial bearing housing;

one or more lower radial bearings positioned between the outer surface of the upper section of the drive shaft and the inner surface of the lower section of the radial bearing housing;

a lower housing comprising:

a spring saddle having an upper section and a lower section, the upper section of the spring saddle being operatively and directly connected to the lower section of the radial bearing housing;

a spacer sub having an upper end and a lower end, the spacer sub being operatively disposed about an outer surface of the lower section of the spring saddle;

a spring having an upper end and a lower end, the spring operatively disposed about the outer surface of the lower section of the spring saddle, the upper end of the spring abutting the lower end of the spacer sub;

a hammer member having an upper end and a lower end, the upper end of the hammer member abutting the lower end of the spring, the lower end of the hammer member including a radial cam profile;

an anvil member having an upper end and a lower end, the upper end of the anvil member including a radial cam surface profile that operatively engages with the radial cam profile of the lower end of the hammer member;

a bit box sub having an upper section and a lower section, the upper section of the bit box sub being operatively connected to the lower end of the anvil member, the lower section of the bit box sub operatively accommodating a bit member;

wherein the lower housing includes an internal bore that operatively accommodates the lower section of the drive shaft.

16. The hammer drill apparatus of claim 15, wherein the lower housing further includes a spline means that operatively attaches the hammer member to the spring saddle.

17. The hammer drill apparatus of claim 15, wherein the lower housing further includes a key interconnecting the drive shaft and the bit box sub, the key allowing rotational movement of the bit box sub via rotation of the flex and drive shafts and lateral movement of the bit box sub relative to the drive shaft.

18. The hammer drill apparatus of claim 15, wherein lower section of the flex shaft is threadedly connected to the upper section of the drive shaft.

19. The hammer drill apparatus of claim 15, wherein the lower end of the anvil member is threadedly connected to upper section of the bit box sub.

20. The hammer drill apparatus of claim 15, wherein the upper section of the spring saddle is threadedly connected to the lower section of the radial bearing housing.

21. The hammer drill apparatus of claim 15, wherein the spring is a coiled spring or a washer spring.

22. The hammer drill apparatus of claim 15, wherein the bit box sub includes an internal angular profile the cooperatively engages with an angular profile of the lower section of the drive shaft to provide axial transmission to the bit box sub and to the bit member of a load force generated by the workstring.

23. The hammer drill apparatus of claim 15, wherein the radial cam profile of the hammer member includes an inclined portion, a flat portion, and an upstanding portion.

24. The hammer drill apparatus of claim 23, wherein the radial cam profile of the anvil member includes an inclined portion, a flat portion, and an upstanding portion.

25. The hammer drill apparatus of claim 15, wherein the workstring is a tubular drill string.

26. The hammer drill apparatus of claim 15, wherein the workstring is a coiled tubing.

* * * * *